US005129380A

United States Patent [19]

Nicol

[11] Patent Number: 5,129,380

[45] Date of Patent: Jul. 14, 1992

[54] FUEL INJECTION PUMP

[75] Inventor: Stuart W. Nicol, London, England

[73] Assignee: Lucas Industries plc, Great Britain

[21] Appl. No.: 715,706

[22] Filed: Jun. 17, 1991

Related U.S. Application Data

[63] Continuation of Ser. No. 433,968, Nov. 8, 1989, abandoned.

[30] Foreign Application Priority Data

Dec. 2, 1988 [GB] United Kingdom ..... 8828159

[51] Int. Cl.[5] ..... F02M 34/00

[52] U.S. Cl. ..... 123/450; 123/506; 123/516; 417/462

[58] Field of Search ..... 123/506, 450, 516, 458; 417/462

[56] References Cited

U.S. PATENT DOCUMENTS

| | | | |
|---|---|---|---|
| 4,572,137 | 2/1986 | Nakatsuka | 123/450 |
| 4,624,233 | 11/1986 | Phillips | 123/506 |
| 4,705,006 | 11/1987 | Bastenhof | 123/458 |
| 4,759,694 | 7/1988 | Thornwaite | 123/450 |
| 4,763,873 | 8/1988 | Phillips | 123/506 |
| 4,779,599 | 10/1988 | Phillips | 123/506 |
| 4,831,991 | 5/1989 | Cayot | 123/516 |
| 4,879,984 | 11/1989 | Rembold | 123/506 |

*Primary Examiner*—Carl Stuart Miller

*Attorney, Agent, or Firm*—Andrus, Sceales, Starke & Sawall

[57] ABSTRACT

A fuel injection pump for supplying fuel to an internal combustion engine includes a bore containing a cam actuated pumping plunger. The bore is connected to an outlet during inward movement of the plunger and a spill valve including a spill valve member is operable to spill fuel from the bore to prevent delivery of fuel to the associated engine. The spill valve member includes a piston portion slidable in a cylinder to which fuel under pressure from the bore can be admitted to move the spill valve member to the open position against the action of a spring. The admission of fuel under pressure to the cylinder can be effected by an electromagnetically operable valve or by the use of a control sleeve, recesses on the internal surface of which in conjunction with porting in a rotary part of the pump, form a control valve.

8 Claims, 4 Drawing Sheets

FUEL INJECTION PUMP

This is a continuation of application Ser. No. 07/433,968, filed Nov. 8, 1989, now abandoned.

This invention relates to a fuel injection pump for supplying fuel to an internal combustion engine, the pump being of the kind comprising a pumping plunger slidably mounted within a bore, means for feeding fuel to the bore to effect outward movement of the plunger, the plunger being movable inwardly by cam means to displace fuel through an outlet in communication with the bore and valve means operable to allow fuel to be spilled from the bore thereby to control the quantity of fuel delivered through the outlet, said outlet in use, being connected to a fuel injection nozzle incorporating a spring biased fuel pressure operable valve member.

The object of the invention is to provide a fuel injection pump of the kind specified in a simple and convenient form.

According to the invention in a pump of the kind specified said valve means comprises a valve member slidable within a cylinder, a seating defined at one end of the cylinder, said valve member defining a head which is located outside of the cylinder, said valve member beneath the head being of reduced diameter to define with the cylinder an annular clearance which is in communication with the bore, the remaining portion of the valve member forming a piston in the cylinder, resilient means biasing the head into contact with the seating and a control valve which in a first position connects the other end of said cylinder to the bore and in a second position to a drain, the arrangement being such that with the control valve in said second position inward movement of the plunger will cause fuel to be displaced through the outlet and if during the inward movement of the plunger the valve is moved to the first position, fuel under pressure from the bore will be admitted to the other end of the cylinder to move the valve member so that the valve head is lifted from the seating to prevent further flow of fuel through the outlet.

Figure 1:
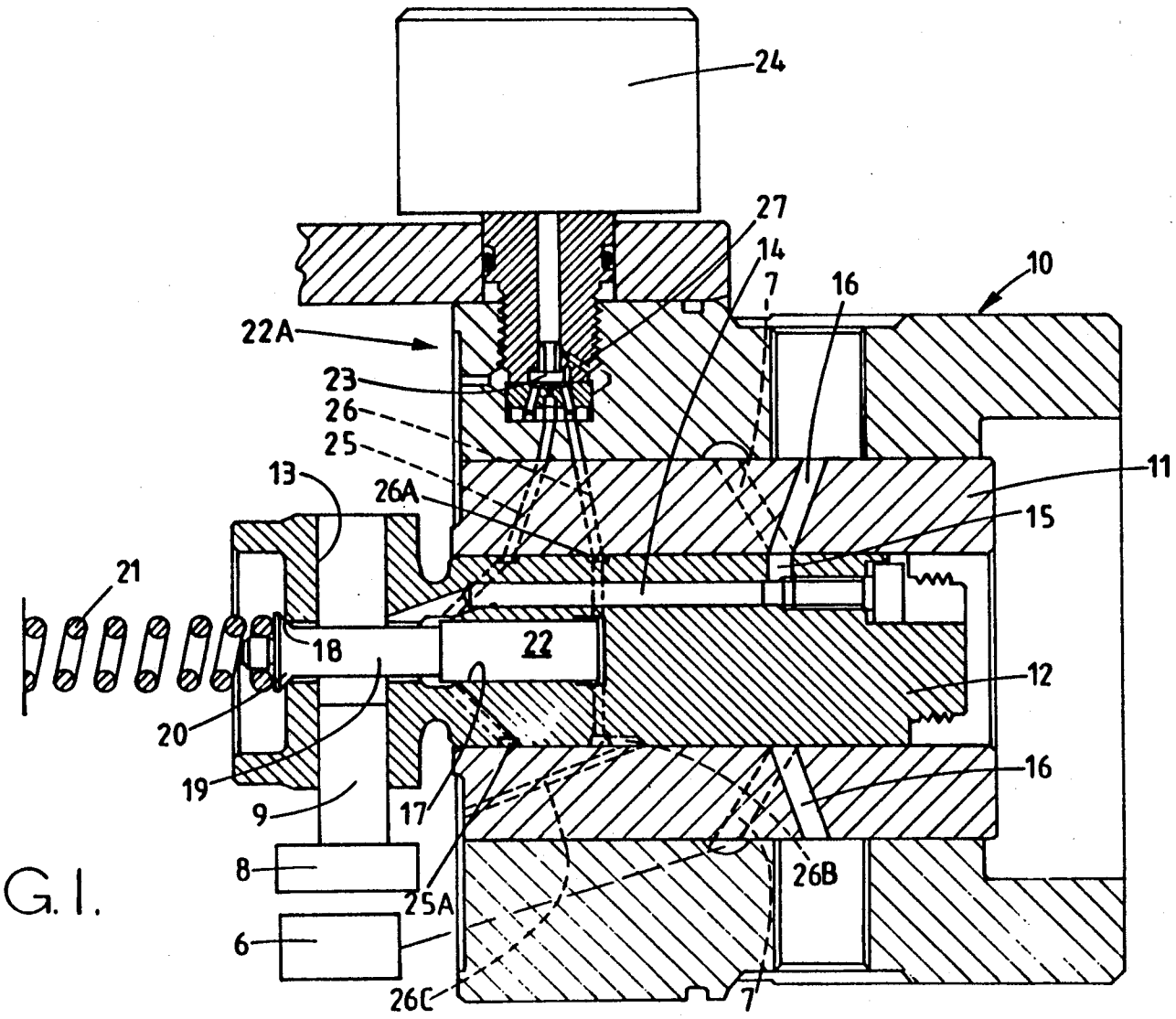
Figure 2:
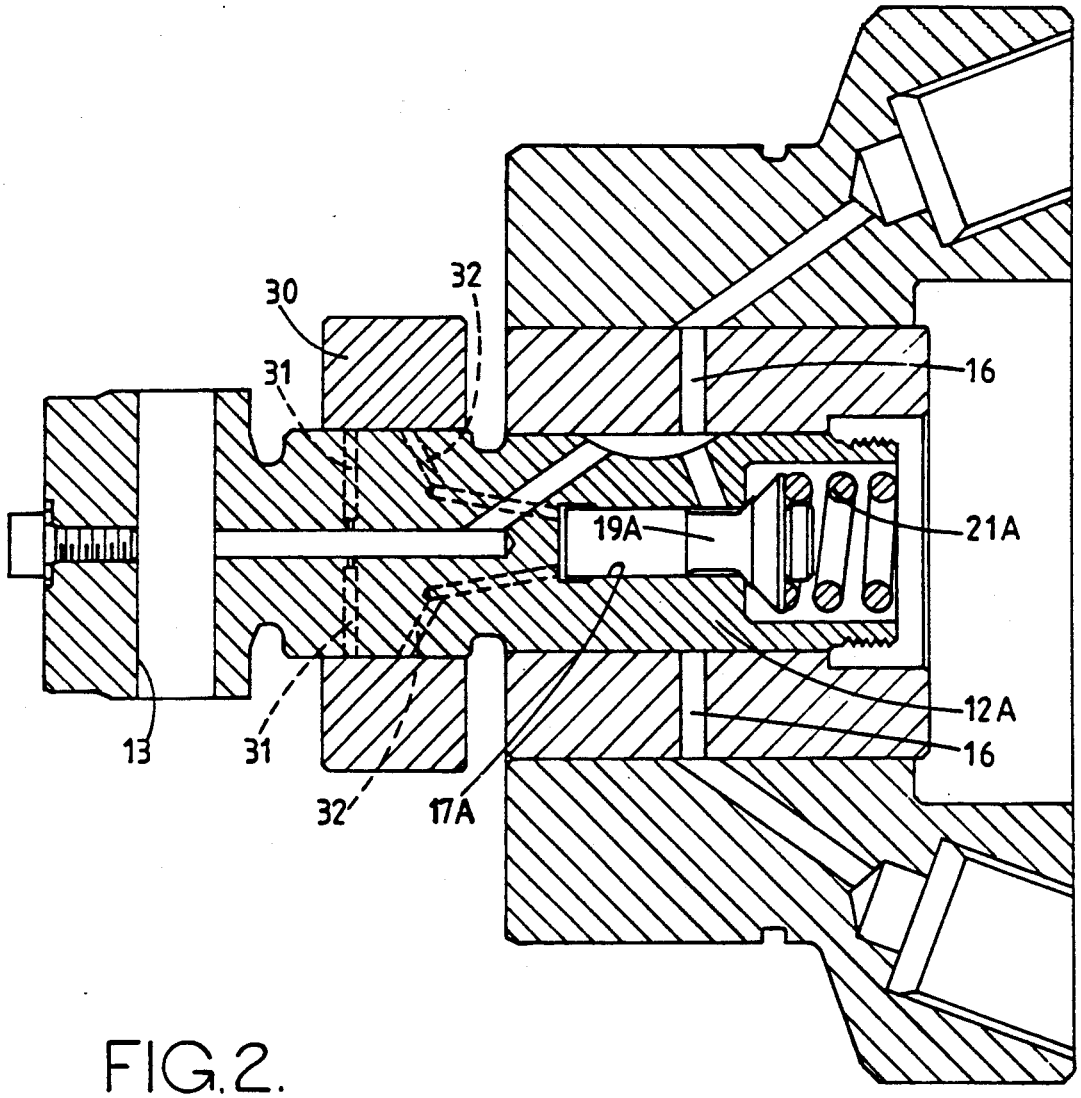
Figure 3:
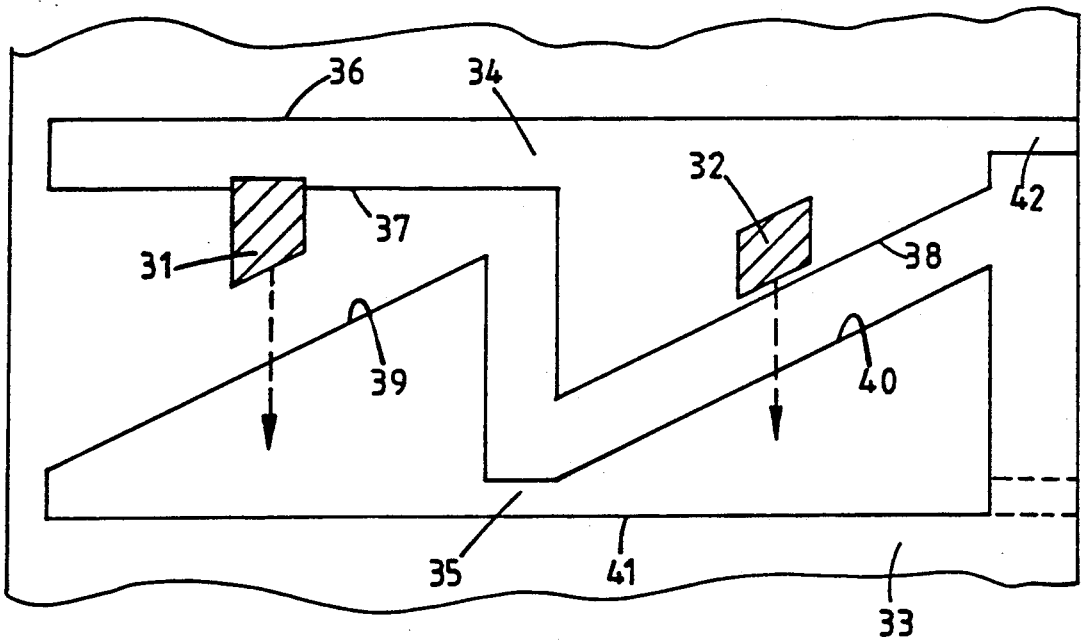
Figure 4:
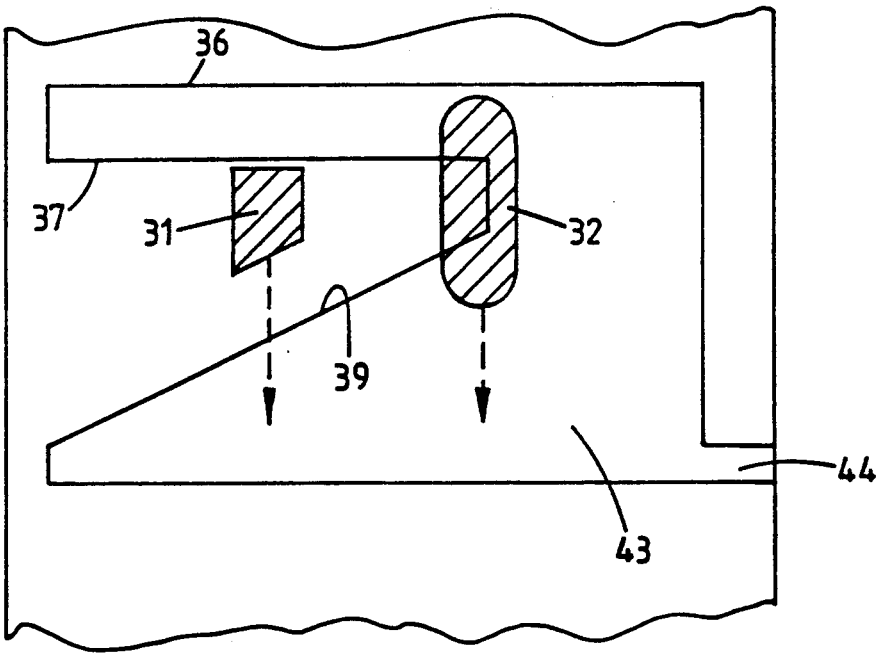
Figure 5:
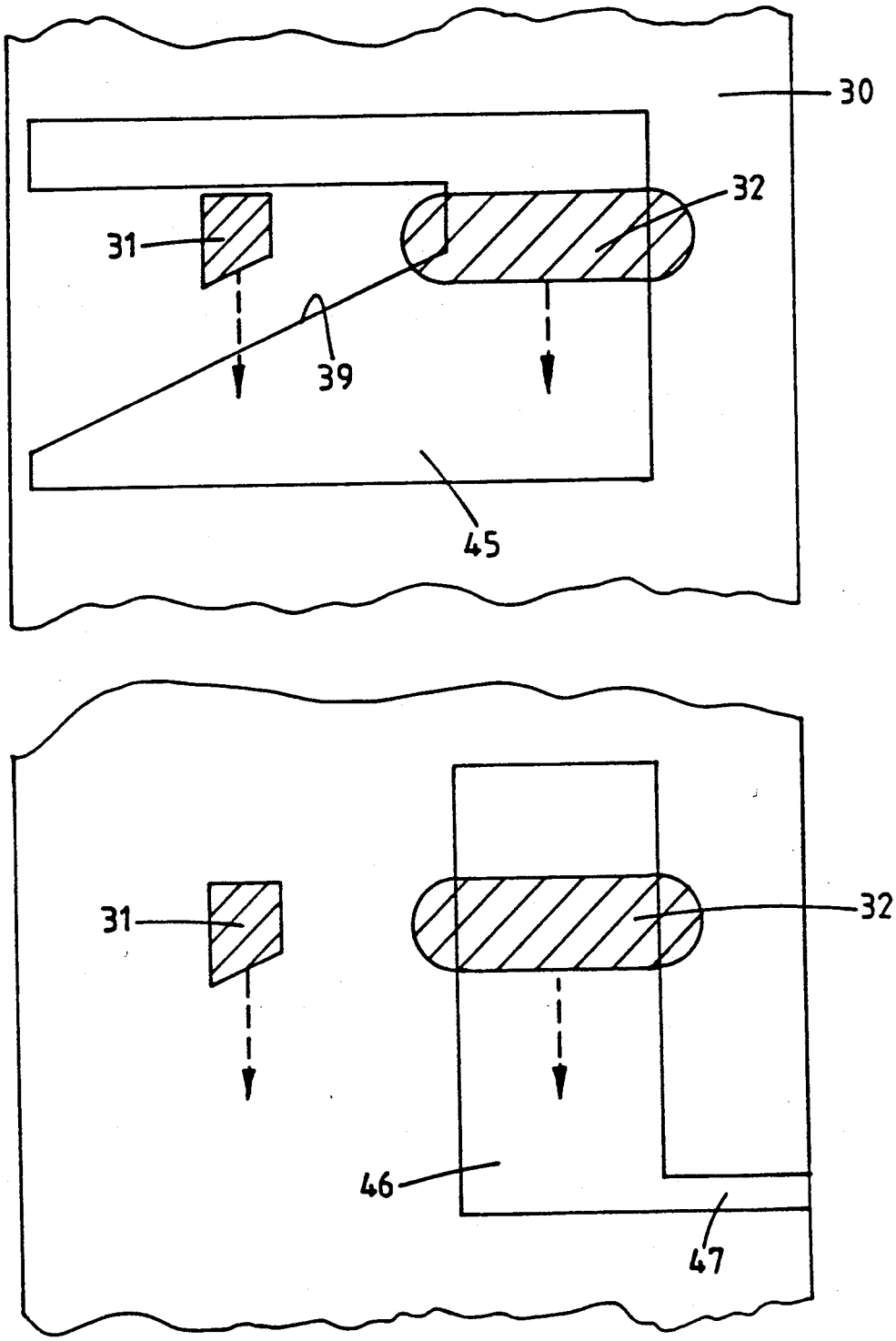

In the accompanying drawings:

FIG. 1 shows in sectional side elevation one example of a pump in accordance with the invention with one form of control valve, FIG. 2 is a view similar to FIG. 1 showing a modified form of the pump with another type of control valve and FIGS. 3, 4 and 5 show diagrams of parts of the pump seen in FIG. 2.

With reference to FIG. 1 of the drawings the pump comprises a body 10 incorporating a tight fitting sleeve 11 in which is mounted a rotary cylindrical distributor member 12 which in use is driven by a drive shaft coupled to a rotary part of the associated engine.

Formed in the distributor member is a transverse bore 13 in which is mounted a pair of pumping plungers 9 only one of which is shown, which are movable inwardly in timed relationship with the associated engine, by cam lobes formed on the internal perpheral surface of a cam ring 8. The intermediate portion of the bore is in constant communication with an axial passage 14 which communicates with a radial passage 15 opening on to the periphery of the distributor member. The passage 15 can register in turn with a plurality of delivery ports 16 in the body 10 and which in use, are connected to the injection nozzles respectively of the associated engine. The injection nozzles are of the conventional type and incorporate a fuel pressure actuated valve member which is resiliently loaded against the force exerted by the fuel pressure. Moreover, alternately arranged with the delivery ports are inlet ports 7 which communicate with the outlet of a low pressure fuel supply pump 6. The passage 15 registers with a delivery port 16 during the whole time the plungers 9 are moved inwardly by the cam lobes and whilst the passage 15 is in register with an inlet port 7 fuel is supplied to the bore to effect outward movement of the plungers, the extent of outward movement being limited by stop means or by the internal surface of the cam ring 8.

In order to control the quantity of fuel supplied at each delivery stroke, a spill valve is provided which can be opened during the inward movement of the plungers to allow fuel displaced from the bore to flow to a drain formed in the example, by a space defined in the pump body. The spill valve includes an axially disposed cylinder 17 formed in the distributor member, the cylinder extending across the bore 13. At the one or open end of the cylinder there is formed a seating 18 and slidable within the cylinder is a valve member 19 having an integral head 20 which is disposed outside the cylinder and is biased into contact with the seating by a coiled compression spring 21, the spring conveniently being located within a drilling formed in the drive shaft.

The valve member beneath the head is of reduced diameter to form with the wall of the cylinder an annular space which communicates with the bore 13. Moreover, the valve member has a piston portion 22 which is slidable in the other end of the cylinder.

A control valve generally indicated at 22A is provided and this is arranged to place the other end of the cylinder in communication with the bore 13 or with a drain such as the aforesaid space defined by the pump body. In the example of FIG. 1 the valve includes a plate valve member 23 which can be urged into contact with a seating by the force exerted by an electromagnetic actuator 24. The seating surrounds a port which by way of a passage 25 in the body 10 is in communication with the bore 13. Moreover, a passage 26 is formed in the pump body and this communicates with a recess defined about the seating of the control valve and also with the other end of the cylinder 17. When the plate valve number is held on the seating the passage 26 is in communication with the aforesaid space by way of a restricted passage 27 in the control valve so that when the actuator is energised the other end of the cylinder is in communication with the space and the head 20 of the valve member is held on the seating by the action of the spring 21.

When the actuator is de-energised the plate valve member is lifted from the seating by the pressure of fuel and the pressure in the other end of the cylinder is raised at least to a value sufficient to positively move the valve member 19 against the action of the spring 21 thereby to allow fuel displaced by the plungers to flow into the space rather than through an outlet 16. The valve member 19 is held open by the fuel pressure in the bore 13 and therefore the valve member acts to control the pressure in the bore. The force exerted by the spring 21 is such that the pressure in the bore 13 while fuel is being spilled, lies below the pressure required to maintain the valve member of the nozzle in the open position. The movement of the valve member is very small so that the flow fuel through the passages 25 and 26 is very small. As a result the seating in the control valve is of small diameter so that the force required to hold the plate valve member in contact with the seating is low.

It will be seen that the portions of the passages 25, 26 in the body 10 and sleeve 11 have intermittent communication with the remaining portions of those passages in the distributor member. In fact there are as many portions of the passages in the distributor member as there are engine cylinders and therefore outlets 16. In practice there will be formed on the distributor member a pair of circumferential grooves 25A, 26A so that constant communication is established. Whilst in theory the member of passage portions in the distributor could be reduced to two, the flow paths would vary depending upon the angular position of the distributor member. It is therefore desirable to provide the full number of passage portions in the distributor member.

The circumferential groove 26A has a plurality of axial grooves 26B only one of which is shown, connecting therewith which register in turn with a drain port 26C in the sleeve towards the end of each filling period thereby to allow while the valve 22A is open, a flow of fuel through the valve 22A and the passage 25 for the purpose of venting air.

In the example seen in FIG. 2 the valve member 19A and the cylinder 17A are located at the opposite end of the distributor member and the control valve comprises a control sleeve 30 which is axially movable on a plain portion of the distributor member 12A. The sleeve is held against rotation with the distributor member. Opening onto the periphery of the distributor member are a pair of ports 31, 32, the port 31 communicating with the bore 13 and the port 32 communicating with the other or inner end of the cylinder 17A. Conveniently the port 31 incorporates a restrictor. The pair of ports 31, 32 are preferably in axial alignment and formed in the internal surface of the sleeve is a recess which at least during the inward movement of the plungers is in communication with the port 32. The recess has a leading edge considered in terms of the direction of rotation of the distributor member, which is inclined to the axis of rotation of the distributor member. Moreover, a restricted leakage path is provided from the recess and the arrangement is such that so long as the port 31 is covered during inward movement of the plungers, the valve member 19A will remain in the closed position and all the fuel displaced by the plungers will be delivered through an outlet 16. When the port 31 is uncovered to the recess, fuel at high pressure from the bore 13 will flow into the cylinder 17A to move the valve member to the open position. A restrictor in the port 31 helps if it is provided, to reduce the rate of flow of fuel and therefore reduces the stress in the spring 21A. It also helps to reduce the pressure in the recess in the sleeve. If the sleeve is moved axially the instant of connection of the port 31 to the cylinder is changed and hence the quantity of fuel which is supplied through the outlet is varied. In order to balance the forces acting on the sleeve at least a further pair of ports corresponding to the ports 31, 32 are provided and where there is only one recess provided on the internal surface of the sleeve, then there must be four pairs of ports in the case of a pump intended to supply fuel to a four cylinder engine.

FIG. 3 shows a view of part of the internal surface of the control sleeve with the ports 31 and 32. The arrows associated with the ports indicate the direction of movement of the ports relative to the sleeve and it will be appreciated that the sleeve can be moved axially, i.e. at right angles to the aforesaid arrows.

The sleeve 33 shown in FIG. 3 is modified as compared with that described above and has a pair of recesses 34, 35. The recess 34 has an axially extending leading edge 36 and as far as the port 31 is concerned an axially extending trailing edge 37. So far as the port 32 is concerned the trailing edge 38 of the recess is inclined. The recess 35 has inclined leading edges 39, 40 associated with the ports 31 and 32 respectively and an axial trailing edge 41. The recess 34 has a groove 42 by which it communicates with a drain.

In operation, the plungers start to move inwardly while the ports 31 and 32 are connected to each other by the recess 34 so that fuel is displaced to the cylinder 17A and the valve member 19A is held open so that no fuel is displaced to an outlet. When the trailing edge 37 covers the port 31 the fuel pressure in the cylinder falls and the valve member 19A moves to the closed position with the fuel being displaced through the port 32 to drain by way of the groove 42. Fuel is therefore displaced through an outlet 16. As the distributor member rotates the port 32 is covered and then since the gap between the edges 38 and 40 is only slightly larger than the port 32, it is uncovered to the recess 35. At the same time the port 31 is uncovered to the recess 35 so that the ports 31 and 32 are again placed in communication to effect opening of the valve member 19A and termination of fuel delivery through the outlet. Moving the sleeve 33 axially varies the period in terms of degrees of rotation of the distributor member during which the valve member is closed and hence the quantity of fuel supplied to the associated engine. Variation of the timing of the start of fuel delivery can be achieved by moving the sleeve angularly however the extent of such movement should not be such that the pumping plungers can start to move inwardly before the ports 31 and 32 are uncovered by the leading edge 36 of the groove 34.

FIG. 4 shows a more practical arrangement in which a single recess 43 is provided the single recess communicating with a drain by way of a restricted groove 44. The port 32 is of elongated form and is in communication with the recess during the whole of the pumping cycle of the pump. The portion of the recess 43 which cooperates with the port 31 is the same as the example of FIG. 3. In this case however when the port 31 is uncovered by the edge 39 there will be a slight delay in the opening of the valve member while the fuel pressure builds up in the recess and is conveyed to the cylinder because of the restricted flow through the groove 44.

If in both the examples of FIGS. 3 and 4, the portions of the recesses 34 and 43 defined by the edges 36 and 37 are omitted the start of fuel delivery will be determined by the setting of the cam ring which controls the plungers and delivery of fuel will start as soon as the plungers start to move inwardly.

In both the examples of FIGS. 3 and 4 arrangements are made to vent any air which may collect in the cylinder and the passages. This is achieved by briefly connecting together the ports 31 and 32 using an additional groove on the internal surface of the sleeve and by connecting one of the other ports 32 to drain. The aforesaid connections takes place during a filling period of the pump.

An alternative arrangement is seen in FIG. 5 in which a recess 45 of the same shape as the recess of FIG. 4 is provided and at another position on the sleeve there is a further recess 46 from which extends a restrictive groove 47 which communicates with a drain. Conveniently, the recess 46 is disposed on the opposite side of the sleeve and communicates with another port 32. When a port 31 is open to the recess 45 fuel flows to the port 32 open to the recess 45 and then the fuel flows by way of the cylinder to the port 32 connected with the recess 46 and from this recess to drain by way of the groove 47. The provision of the recess 46 besides allowing the fuel flow to remove air also provides for at least partial balancing of the forces acting on the sleeve.

It will be appreciated that the valve member 19A of FIG. 2 can be controlled by the form of control valve which is shown in FIG. 1 and the valve member 19 of FIG. 1 can be controlled by the form of control valve seen in FIG. 2.

I claim:

1. A fuel injection pump for supplying fuel to an internal combustion engine comprising a pumping plunger slidably mounted in a bore, means for feeding fuel to the bore to effect outward movement of the plunger, cam means for effecting inward movement to the plunger to displace fuel through an outlet, valve means operable to allow fuel to be spilled from the bore to control the quantity of fuel delivered through said outlet, the outlet in use being connected to a fuel injection nozzle incorporating a fuel pressure operable valve member, said valve means comprising a valve member slidable within a cylinder, a seating defined at one end of the cylinder, said valve member defining a head located outside the cylinder, the valve member beneath the head being of reduced diameter to defined with the cylinder an annular clearance in communication with the bore, the remaining portion of the valve member forming a piston in the cylinder, resilient means biasing the head into contact with the seating and a control valve which in a first position connects the other end of the cylinder to the bore such that the bore pressure biases the valve to the open position and in a second position to drain, whereby in said first position of the control valve the head of the valve member will be lifted from the seating to allow fuel to be spilled from the bore and in said second position of the control valve the head will be in engagement with the seating to allow fuel to be displaced through the outlet.

2. A pump according to claim 1 in which said control valve is an electromagnetically operable valve.

3. A pump according to claim 1 or claim 2 in which said bore is formed in a rotary distributor member mounted for rotation within a sleeve in a pump body, a delivery passage communicating with the bore, the delivery passage registering in turn with an outlet and an inlet port, a first passage communicating said bore with the control valve and a second passage in the distributor member, communicating said other end of the cylinder with said control valve said first and second passages each including portions in the distributor member and the sleeve, there being as many portions of the first and second passages, in the distributor member as there are outlets.

4. A pump according to claim 3 in which the outer ends of the portions of the second passage communicate with a circumferential groove, a plurality of axial grooves on the distributor member and communicating with said circumferential groove and a drain port with which said axial grooves communicate in turn towards the end of the filling periods of the bore.

5. A pump according to claim 1 in which said bore is formed in a rotary distributor member mounted in a sleeve in a pump body, a delivery passage communicating with the bore, the delivery passage registering in turn with an outlet and an outlet port a first port on the periphery of the distributor member said first port communicating with said bore, a second port on the periphery of the distributor member and communicating with said other end of the cylinder, a control sleeve mounted about the distributor member and movable axially thereon, and a recess formed in the internal surface of the sleeve, said recess having an inclined leading edge which during inward movement of the plunger uncovers said port to the recess said second port at the instant the first port is uncovered to the recess also communicating with the recess.

6. A pump according to claim 5 in which the second port is of elongated form and is in communication with the recess during the whole of the pumping cycle of the pump, there being provided a restricted groove communicating with the recess and extending to a drain.

7. A pump according to claim 5 including a further recess formed in the internal surface of the sleeve, said further recess being positioned relative to the recess so that it is uncovered to a further port at least during the inward movement of the plunger, there being provided a restricted groove communicating with the further recess and extending to a drain.

8. A pump according to claim 5 including a further recess positioned in advance of the first mentioned recess, the further recess defining an axially extending edge which covers said first port to determine the start of fuel delivery though the outlet, said further recess communicating with a restricted passage extending to a drain.

* * * * *